US005626431A

United States Patent [19]

Hetzer et al.

[11] Patent Number: 5,626,431

[45] Date of Patent: May 6, 1997

[54] FELT-TIP PEN WTH REFILLING MEANS

[75] Inventors: Norbert Hetzer, Lobbach; Michael Schwarz, Herne, both of Germany

[73] Assignee: Esselte Meto International GmbH, Heppenheim, Germany

[21] Appl. No.: 592,334

[22] PCT Filed: Jul. 5, 1994

[86] PCT No.: PCT/EP94/02199

§ 371 Date: May 16, 1996

§ 102(e) Date: May 16, 1996

[87] PCT Pub. No.: WO95/04661

PCT Pub. Date: Feb. 16, 1995

[30] Foreign Application Priority Data

Aug. 4, 1993 [DE] Germany ..... 43 26 174.4

[51] Int. Cl.[6] ..... B43K 11/00

[52] U.S. Cl. ..... 401/119; 401/36; 401/131; 401/199; 401/207

[58] Field of Search ..... 401/36, 119, 131, 401/199, 202, 207

[56] References Cited

U.S. PATENT DOCUMENTS

| | | | |
|---|---|---|---|
| 1,878,879 | 9/1932 | Mon | 401/36 X |
| 2,523,879 | 4/1950 | Rosenthal | 91/54.5 |
| 3,195,169 | 7/1965 | Chadbourn | 15/517 |
| 3,480,371 | 11/1969 | Lee | 401/121 |
| 3,932,044 | 1/1976 | Otake et al. | 401/265 |
| 4,614,163 | 9/1986 | Hetzer et al. | 118/268 |
| 5,297,883 | 3/1994 | Ozu | 401/202 |

FOREIGN PATENT DOCUMENTS

| | | | |
|---|---|---|---|
| 137171 | 7/1984 | European Pat. Off. . | |
| 7113467 | 12/1971 | France . | |
| 1936414 | 4/1966 | Germany . | |
| 2456905 | 6/1975 | Germany . | |
| 2907531 | 9/1980 | Germany . | |
| 3713727 | 11/1988 | Germany . | |
| 4241476 | 6/1993 | Germany . | |
| 1133979 | 11/1968 | United Kingdom | 401/119 |
| 1324474 | 7/1973 | United Kingdom . | |

*Primary Examiner*—Steven A. Bratlie
*Attorney, Agent, or Firm*—Pennie & Edmonds

[57] ABSTRACT

A felt-tip pen (1) for writing on posters or the like is inserted into an ink pot for refilling and keeping. In order to prevent the outer sides of the felt-tip pen from becoming soiled with ink, the felt-tip pen has an axial groove (12) parallel to the felt-tip (10) entered by a collar (22) that surrounds the opening (21) of the ink pot (20) when the felt-tip pen is inserted through the opening. This groove is designed in an intermediate piece (5) that bears the felt-tip and that is in turn inserted onto the cup-shaped end (3) of the handle with a second groove (11 ) of the same size as the first but oriented in the opposite direction. The felt-tip may thus be inserted on both sides onto the handle (2) and into the ink pot and at the same time it is well sealed in the ink pot.

5 Claims, 1 Drawing Sheet

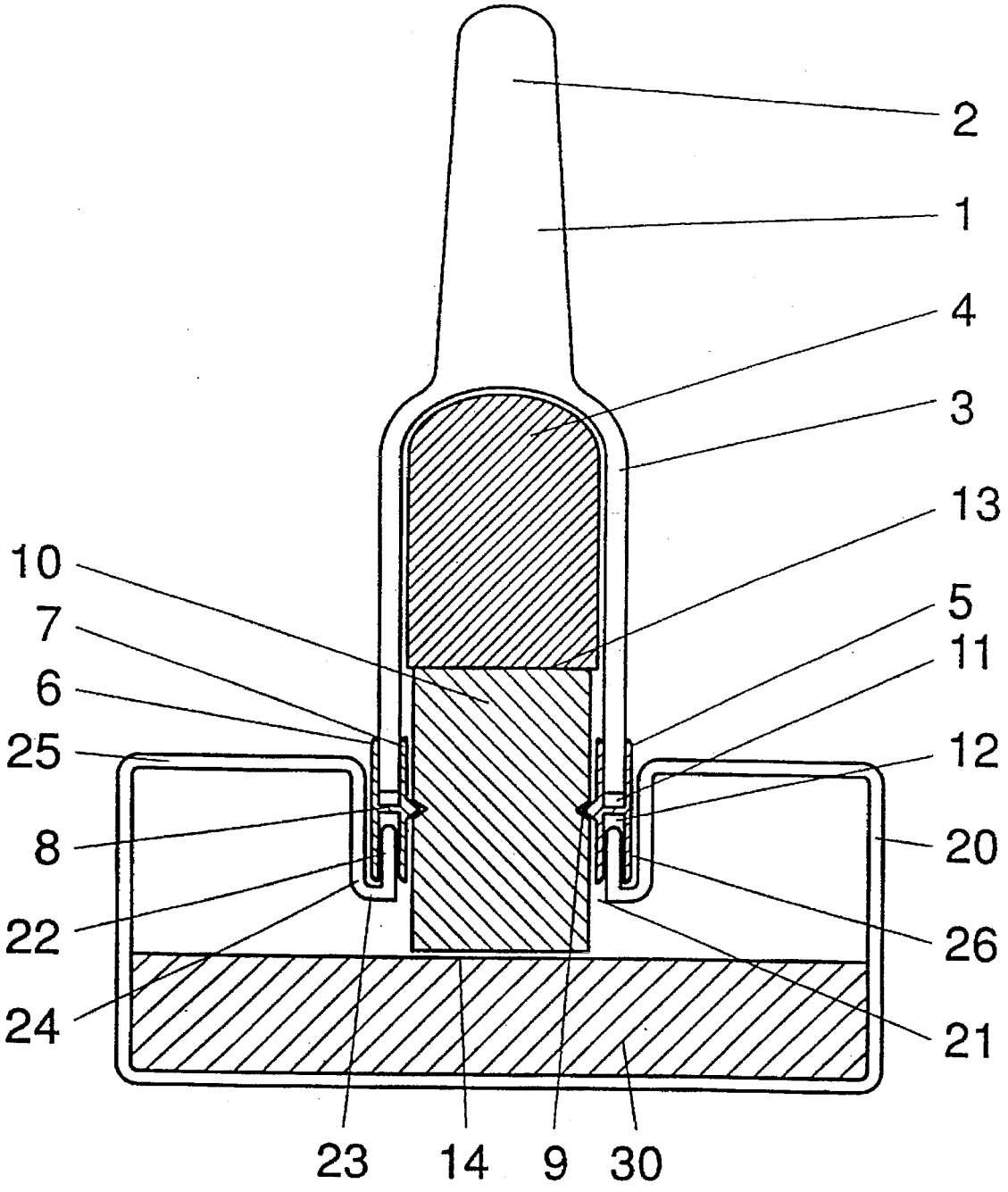
2
1
4
3
13
10
5
7
11
6
25
12
8
20
22
26
24
21
23
14
9
30

FELT-TIP PEN WTH REFILLING MEANS

TECHNICAL FIELD

This invention relates to a device for writing on posters and the like, comprising an inkwell and a felt-tip pen, with the felt-tip pen including a handle member and a felt tip secured therein which has one end thereof extend out of the handle member. A felt-tip pen of this type is known from U.S. Pat. No. 4,614,163.

BACKGROUND OF THE INVENTION

In the prior known felt-tip pen, the felt tip is held in an intermediate piece exchangeably secured to the handle member, and is in abutting engagement with a reservoir structure inside the handle member. In this arrangement, the intermediate piece is of a tapering configuration in the direction of the felt tip. This enables the felt-tip pen to be inserted into a funnel-shaped opening of an inkwell until the tip of the felt tip takes support upon an absorbent body disposed in the inkwell. As a result of capillary action, the ink contained in the inkwell rises in the absorbent body, impregnating the felt tip resting thereon. Capillarity being also present in the felt tip, causing the ink to rise, the reservoir structure in the handle member becomes equally impregnated with ink. The supply of ink consumed by the felt-tip pen is thus replenished automatically during breaks between uses.

When the pen is inserted into the inkwell, it occurs frequently that the felt tip contacts the wall of the funnel, smearing it with ink. This ink is then directly transferred to the outside of the intermediate piece. When the user's fingers hold the felt-tip pen by the forward end in the area of the intermediate piece to resume writing, they will promptly become stained with ink.

A further disadvantage is that the felt-tip pen effects a poor seal or no seal at all when inserted into the funnel. In cases where an excessively narrow funnel is selected, the writing point fails to reach the absorbent body, the felt-tip pen being already stuck short of reaching it, in addition to being wedged considerably. Ink is then prevented from rising up into the felt-tip pen. It is also not possible to accurately match the dimensions of funnel, intermediate piece, length of the writing point and height of the absorbent body, because the writing point is exposed to wear in use, and the absorbent body expands to a greater or lesser degree, depending on the quantity of ink absorbed. In the known embodiment of the felt-tip pen, it is thus necessary ultimately to provide a specified gap between the funnel of the inkwell and the intermediate piece in order to ensure proper functioning. Considering, however, that the felt-tip pen is customarily inserted into the inkwell for storage also during prolonged periods of non-use, this gap logically causes the ink in the inkwell to dry out. Not only is ink thereby wasted uselessly, but the vaporization of the ink also changes its consistency, impairing or even ruining the writing quality and also the replenishment effect. Further, depending on the composition of the ink, noxious fumes are continuously released.

It is an object of the present invention to configure a felt tip pen device of the type initially referred to such as to effect a tight seal on insertion of the felt-tip pen into the opening of a congruent inkwell, without the felt-tip pen becoming wedged in the opening of the inkwell. It is a further object to configure the felt-tip pen in such a fashion as to prevent the outer contour of the felt-tip pen from becoming soiled with ink.

According to the present invention, this object is accomplished in that a groove concentric with the longitudinal axis of the felt tip is provided, the groove encompassing the felt tip immediately behind the protruding end of the felt tip and being open in the direction of this end, thus enabling the felt-tip pen to be introduced into an opening of an inkwell, in which process a collar encompassing the opening engages within the groove, the felt tip encountering an ink-impregnated absorbent body before the collar reaches the bottom of the groove. This embodiment ensures that ink smudges occurring at the opening of the inkwell are prevented from being transferred to the outer contour of the felt-tip pen, because at no time is this outer contour introduced into the opening. Yet, the felt-tip pen may be provided with a comparatively slim design, so that view of the writing point is not obstructed in use. In this arrangement, groove and collar of the inkwell may extend perfectly parallel to each other, with a small gap being maintained on both sides of the collar. This thus effectively avoids wedging of the felt-tip pen as it occurs in the prior-art felt-tip pen due to its conical intermediate piece. In spite of this gap, a tight seal is effected, because the gap between the collar of the inkwell and the felt-tip pen extends in U-shape, thus forming a labyrinth-type seal. For maximum length of the labyrinth, it will be advantageous to provide the groove with a depth which is a multiple of its width. The labyrinth effectively prevents the ink in the inkwell from drying out with the felt-tip pen seated in place. Moreover, if the collar on the inkwell is arranged in a cylindrical hollow whose inside diameter is only slightly greater than the outside diameter of the intermediate piece, a third sealing gap results enhancing the effect of the labyrinth still further. In this configuration, the labyrinth is S-shaped, without this increasing the material requirements for the wearing part of the felt-tip pen.

In the felt-tip pen constructed in accordance with the present invention, wear of the felt tip and/or the absorbent body is effectively compensated for. The relative distance of the groove bottom and the upper end of the collar can be amply dimensioned to compensate for differences. The effect of the labyrinth is even substantially improved by a large distance at this particular location, since changes of cross section are generally desirable in labyrinth seals in order to achieve the full effect.

For a felt-tip pen in which the felt tip is held in an intermediate piece exchangeably attached to the handle member and is in abutting engagement with a reservoir structure inside the handle member, it is another object to configure the intermediate piece such that the felt tip can be used with both of its ends, affords ease of manufacture and ready replacement.

This further object is accomplished in that the intermediate piece is comprised of an inner and an outer sleeve concentrically arranged with each other, with the sleeves being interconnected by a central link member such as to produce two equal grooves extending concentrically with the longitudinal axis of the felt tip disposed in the inner sleeve and protruding from both ends, and that the handle member is inserted into one of the grooves for locking engagement therein. The locking engagement can be accomplished simply by providing in the inner sleeve in the area of the link member an inwardly extending projection holding the inserted felt tip captive. The felt tip is then press-fitted into the intermediate piece. In addition, a particular advantage results if the felt tip extends from both ends of the intermediate piece by the same length and is configured as a writing end. This results in a perfectly symmetrical shape of the intermediate piece and the felt tip. The intermediate piece includes two identical grooves extending in opposite directions. With its first, upper groove, the intermediate piece is pushed onto the congruent handle member until the felt tip extending into the handle member engages the reservoir structure received therein. As this occurs, the locking engagement between the handle member and the intermediate piece is conveniently accomplished by a press fit. With its other groove, the intermediate piece is placed down onto the inkwell as described in the foregoing. When the first end of the felt tip extending out of the handle member of the pen is worn down, the intermediate piece holding the felt tip can be simply detached from the handle member and, using a turning motion through 180°, can be put back in place. Thus, the second end of the felt tip is available for use. With the embodiment of the present invention it is thus possible for the wearing part of the felt-tip pen, that is, the expensive felt tip and the intermediate piece to which it is attached, to be put to double use, resulting in a 50% savings of these parts aside from affording functional advantages.

BRIEF DESCRIPTION OF THE DRAWINGS

Further advantages will become apparent from the subsequent description of an embodiment with reference to the accompanying drawing which illustrates, in cross-section, the felt-tip pen device of the present invention.

In the sole FIGURE of the drawing, a felt-tip pen 1 having a handle member 2 is shown. The handle member 2 has a downwardly extending cup-shaped portion 3 in which an absorbent reservoir structure 4 is located. An intermediate piece 5 is attached to the open end of the cup-shaped portion 3. This intermediate piece 5 is comprised of an inner sleeve 7 and an outer sleeve 6 interconnected in the middle of their length by means of a link member 8. Within the inner sleeve 7 in the area of the link member 8, a projection 9 is formed tapering to a pointed end in the direction of the center line of the inner sleeve 7. Press-fitted into the intermediate piece 5 is a felt tip 10 secured against axial displacement by the projection 9. The felt tip 10 projects from both ends of the intermediate piece 5 by the same length, its two ends being configured as writing ends 13 and 14. According to the embodiment described, the intermediate piece 5 includes two grooves 11 and 12 of equal depth which are open in upward and downward direction, respectively, when viewing the drawing. The intermediate piece 5 has its upper groove 11 pushed into engagement with the open end of the cup-shaped portion 3. The wall thickness of the cup-shaped portion 3 is dimensioned such as to be a press-fit within the groove 11, insertion therein being only possible at a considerable effort. Insertion into the groove is stopped when the writing end 13 abuts the reservoir structure 14. To compensate for length variations, a free space is maintained at the bottom of the groove.

In use of the felt-tip pen 1, the writing end 14 eventually wears down. As becomes readily apparent from the FIGURE, when the permissible amount of wear is exceeded, the intermediate piece 5 plus felt tip 10 can be pulled off from the cup-shaped portion 3 of the handle member 2, turned through 180°, and replaced. The second writing end 13 is thus available for further use, while the worn end engages the reservoir structure 4 inside the handle member 2 for feeding the ink. This embodiment thus enables both ends of the relatively expensive felt tip to be used.

During periods of non-use, that is, at night and during breaks between uses, the felt-tip pen 1 is stored in an inkwell 20 as shown in the drawing. To this end, the inkwell 20 has an opening 21 bounded by a vertically upwardly extending collar 22. The collar 22 is shaped to register with the groove 12 of the intermediate piece, yet of a wall thickness somewhat smaller than the width of the groove 12, and of a height somewhat lower than the depth of the groove 12. The collar 22 is provided on a horizontal wall portion 23 merging into a vertical wall portion 24 which, on extending to a height nearly double the height of the collar 22, curves into a plane portion of the housing 25 of the inkwell 20. The vertical wall portion 24 thus forms a hollow 26 encompassing the opening 21. The inkwell 20 also accommodates an absorbent body 30 impregnated with ink on which the writing end 14 of the felt tip 10 sits in order to be saturated with ink.

As the felt-tip pen 1 is inserted into the opening 21, the distance relative to the vertical wall portion 24 is relatively large, so that there is hardly any risk for the felt tip impregnated with ink to come into contact with this wall portion 24. As soon as the intermediate piece 5 enters the hollow 26, the felt-tip pen is guided by the intermediate piece 5 through the hollow 26 and accurately directed into the opening 21. In the process, the collar 22 enters the groove 12 until the writing end 14 of the felt tip encounters the absorbent body 30. A respective free space is then maintained above the collar 22 at the bottom of the groove 12 and below the outer sleeve 6 above the horizontal wall portion 23, so that tolerances and length variations of the felt tip 10 are compensated for.

Although a certain amount of clearance and thus an open gap is provided between all parts of the intermediate piece 5 and the inkwell 20 for greater ease of handling, this embodiment is still capable of effecting a tight seal of the felt-tip pen in the inkwell, because the gap extends in S-shape, thus forming a labyrinth. Gases which are lighter than air, get trapped in the space above the collar 22, forming a barrier. In the presence of gases heavier than air, these will collect in the space below the outer sleeve 6. This type of seal is thus equally suited to various types of ink using any conceivable solvent.

If, during insertion of the felt-tip pen 1 into the opening 21, the felt tip 10 contacts the inner surface of the collar 22, producing ink smudges on this surface, these are prevented from being transferred to the outside of the intermediate piece 5, reaching invariably only the groove 12. In consequence, the outsides of the felt-tip pen 1 are kept free from ink at all times, thus precluding soiling of the user's fingers during handling. Ink can only be transferred from the felt tip 10 direct. It is not possible to hold the felt-tip pen 1 by soiled outsides.

In the embodiment of the felt-tip pen 1 with intermediate piece 5 as disclosed in the present invention, the particular configuration of the intermediate piece 5 enables the felt tip to be used with both its ends, while at the same time a tight seal is effected in the inkwell 20 affording ease of handling without wedging.

What is claimed is:

1. A device for writing on posters and the like, comprising an inkwell and a felt-tip pen, with the felt-tip pen including a handle member and a felt tip secured therein which has one end thereof extending out of the handle member, characterized in that a groove (12) concentric with the longitudinal axis of the felt tip (10) is provided, said groove encompassing the felt tip (10) immediately behind the protruding end of the felt tip (10) and being open in the direction of said end, thus enabling the felt-tip pen (1) to be introduced into an opening (21) of the inkwell (20), in which a collar (22) encompassing the opening (21) engages said groove (12), the felt tip (10) encountering an ink-impregnated absorbent body (30) before the collar (22) reaches the bottom of the groove.

2. A felt-tip pen as claimed in claim 1, characterized in that the depth of the groove (12) is a multiple of its width.

3. A felt-tip pen as claimed in claim 1, characterized in that the felt tip (10) is held in an intermediate piece (5) exchangeably attached to the handle member (2) and is in abutting engagement with a reservoir structure inside said handle member (2), that the intermediate piece (5) is comprised of an inner and an outer sleeve (6, 7) concentrically arranged with each other, said sleeves (6, 7) being interconnected by a central link member (8) to produce two equal grooves (11, 12) extending concentrically with the longitudinal axis of the felt tip (10), and that the handle member (2) has a cup-shaped portion (3) inserted into one of the grooves (11, 12) for locking engagement therein.

4. A felt-tip pen as claimed in claim 3, characterized in that in the inner sleeve (7) in the area of the link member (8) an inwardly extending projection (9) is provided holding the inserted felt tip (10) captive.

5. A felt-tip pen as claimed in claim 3, characterized in that the felt tip (10) extends from both ends of the intermediate piece (5) by the same length and has both its ends configured as writing ends.

* * * * *